US005192030A

United States Patent [19]

Jakobs

[11] Patent Number: 5,192,030

[45] Date of Patent: Mar. 9, 1993

[54] TWO ROLLER MACHINE, PARTICULARLY A ROLLER PRESS

[75] Inventor: Willy Jakobs, Cologne, Fed. Rep. of Germany

[73] Assignee: Kloeckner-Humboldt-Deutz AG, Fed. Rep. of Germany

[21] Appl. No.: 737,681

[22] Filed: Jul. 30, 1991

[30] Foreign Application Priority Data

Jul. 30, 1990 [DE] Fed. Rep. of Germany ..... 4024109

[51] Int. Cl.[5] ..... B02C 4/32

[52] U.S. Cl. ..... 241/101.2; 241/232; 241/234

[58] Field of Search ..... 241/232, 233, 234, 101.2, 241/205; 72/240, 243, 199; 100/168, 169, 155 R

[56] References Cited

U.S. PATENT DOCUMENTS 4,519,188 5/1985 Webster et al. ..... 100/169

FOREIGN PATENT DOCUMENTS 3723605 1/1989 Fed. Rep. of Germany ..... 241/234

0695008 4/1952 United Kingdom ..... 241/232

*Primary Examiner*—Frank T. Yost

*Assistant Examiner*—Allan M. Schrock

*Attorney, Agent, or Firm*—Hill, Steadman & Simpson

[57] ABSTRACT

A two roll crusher including a pair of parallel rollers forming a crushing nip therebetween with gearings at the ends of the rollers and a plate connected to each of the gearings for absorbing reaction moments, torsion rods extending parallel to the plates with spaced arms of unequal length and links connecting the arms to the plates so that the reaction moments of the plate is transmitted to twist the torsion rods with the rods designed to support the weight of the gearing of the rollers.

8 Claims, 1 Drawing Sheet 1
2
3
4
5
6
7
8
9
10
11
12
13
13a
13b
14
14a
14b
15
16
17
18
(+)
(-)
A
B
R
r
II
III

TWO ROLLER MACHINE, PARTICULARLY A ROLLER PRESS

BACKGROUND OF THE INVENTION

The invention relates to two roller machines and particularly to roller presses.

In a roller press of the type with which the invention is employed, two rollers are rotatably seated in a housing and driven in opposite directions and form a nip therebetween for crushing material in the nip. The invention is particularly well suited for a two roll crusher of the type performing product bed crushing wherein unusually high nip pressures are employed so as to form incipient cracks in the material being crushed. Such a roller press is disclosed in the U.S. Pat. Nos. 4,357,287, Schoenert, 4,703,897, Beisner be understood, however, that features of the invention may be used with equal advantage for various types of two roller machines, although particularly well suited for the product bed crushing type of press referred to above.

In the general type of mechanism, the two rolls have gearings connected to the driving shafts of the rollers and the gearings are provided with torque supports for absorbing the reaction moments. In the present invention, the torque supports are in the form of lever plates which extend in opposite directions away from the gearings but are firmly connected to the gearings. These lever plates are uniquely rotationally connected via link rods and torque arms to torsion shafts for absorbing the moments of the gearings.

One form of mechanism is disclosed in German Patent 3901060 and the corresponding U.S. Pat. Nos. 5,005,775 wherein the gearings are connected to the driving shafts of the rollers and are provided with torque supports for absorbing the reaction moments. The torque supports are comprised of lever plates having arms extending parallel and fashioned of identical lengths and are rigidly connected to the gearing and to each other at the ends with flexible linkage.

In the foregoing arrangement, the lever arms are connected by links so that absorption of the shearing forces is achieved. This type of arrangement, however, is limited because of the space required and only one gearing can be arranged at one side of a two roller machine. This requirement of additional space creates disadvantages particularly where reconstruction of existing roller mills is involved.

FEATURES OF THE INVENTION

An object of the present invention is to provide an improved support and torque absorbing arrangement for two roll roller presses which avoids disadvantages present in structures heretofore available and particularly which has reduced space requirements.

A further object of the invention is to provide an improved arrangement for absorbing the moments of the drive gearings in a two roll press wherein the structure can support the weight of the gearings.

A further object of the present invention is to provide a structural arrangement wherein the reaction moment of gearings for two roll presses is absorbed and yet lateral excursionary movements of the rollers is permitted without adversely affecting the functions of the moment absorbing apparatus.

In accordance with the invention, plate arms are connected to the gearings for the drive for a parallel roll crusher. These plate arms transmit their rotational moments to a torsion shaft via arms projecting from the torsion shafts wherein the arms are of unequal lengths. In the arrangement, the gearings for the rollers can be advantageously arranged side-by-side at one side of a two roller machine and as a result, the structure is more compact than heretofore available. Both the roller bearings as well as the machine frame are kept free of shearing forces without impeding the excursionary motion of the movable rollers or of the movement of one roller relative to one fixed roller.

By the arrangement of lever arms connected to the torsion shaft so that the lever arms are of unequal length, the bearing or gearing of the shafts can be partially or completely relieved of the weight of the gearing and motor.

Other objects, advantages and features will become more apparent with the teaching of the principles of the invention in connection with the disclosure of the preferred embodiments thereof in the specification claims and drawings, in which:

DESCRIPTION OF THE PREFERRED EMBODIMENT

Figures 1, 2, 3:
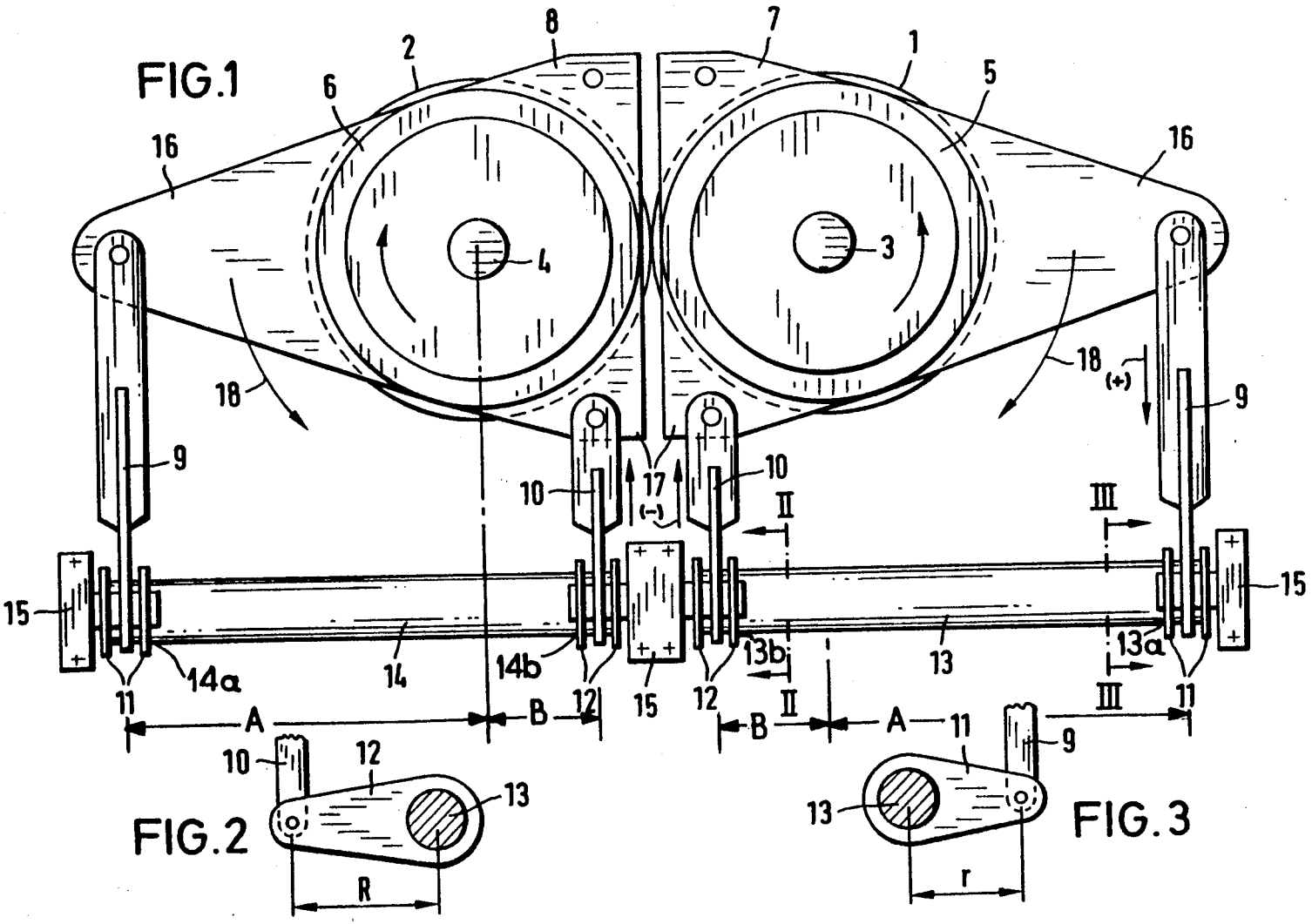
FIG. 1 is an end elevational movement of a two roll roller press provided with a moment support constructed and operating in accordance with the principles of the present invention.
FIG. 2 is a fragmentary sectional view taken substantially along line II—II of FIG. 1.
FIG. 3 is a fragmentary sectional view taken substantially along line III—III of FIG. 1.

As FIG. 1 illustrates, a two roller machine is shown comprised of rollers 1 and 2 driven in opposite directions and rotatably supported and seated in a housing, not shown. The rollers form a nip therebetween and are driven by a suitable mechanism, not shown, in opposite directions for passing pulverulent material through the nip.

The rollers have drive gearings 5 and 6 which are connected to driving shafts 3 and 4 of the rollers. The gearings 5 and 6 are provided with torque supports for absorbing the reaction moments. These torque supports are shown in the form of double lever plates 7 and 8 which respectively are connected to the gearings 5 and 6 and project in opposite directions from the roll press.

Below the plates and offset from the plane thereof are torsion shafts 13 and 14.

The plates 7 and 8 are rigidly connected to the gearings 5 and 6 and pivotally connected to the plates are links or rods 9 and 10. As will be seen from the drawings, the links 9 are connected to the outer ends of the plates and the links 10 are connected to the inner ends of the plates with the connections being pivotal and being at different distances from the centers of the rolls. The links 9 are at a distance A from the axis of the rolls 1 and 2. The links 10 are at a distance B from the axis of the rolls 1 and 2. With the reaction forces on the gearings, the plates will tend to be rotated in the direction indicated by the arrowed lines 18.

Torsion shafts 13 and 14 extend longitudinally in planes substantially parallel to the plates 7 and 8 and have outer ends **13*a* and 14*a* and inner ends 13*b* and 14*b***.

The links 9 are connected to the outer ends **13*a* and 14*a* of the torsion shafts 13 and 14 by lever arms 11. The links 10 are connected to the inner ends 13*b* and 14*b* of the torsion shafts 13 and 14 by lever arms 12. These lever arms are shown in detail in FIGS. 2 and 3** and are of different lengths.

The torsion shafts 13 and 14 are rotatably supported by the machine frame on bearings 15 and are independent of each other but positioned in coaxial locations.

The arrangement of the plates 16 and 17 which serve as torque supports provide an extremely space saving arrangement for the gearings 5 and 6 at one end of the roller machine. This enables an extremely compact space saving structure for a two roller machine.

As shown in FIGS. 2 and 3, the lever arms 11 and 12 which are secured to the torsion shafts 13 or 14 are of unequal length. Since each torsion shaft is constructed similarly, the arrangement of FIG. 2 represents the structure for either torsion shaft 13 or 14.

In the structure as shown, the lever arm 11, which is at the outer end of the plate 16, is longer. The lever arm 11, which is positioned inwardly and connected to the link 10 is shorter. The arm 11 is shown with an effective lever arm length r and the lever arm 12 is shown with an effective lever arm length R. Due to the unequal length of the lever arms, the bearing of the shaft can be advantageously partially or completely relieved of the dead weight of the gearing and of the drive motor. The link 9 is thereby stressed for compression and the link 10 is stressed for tension due to the reaction moments shown by the arrows 18 which moments occur during operation of the two roller press.

As a result of this unequal fashion of the length of the location of connection to the plates 16 and 17 and the respective lengths of lever arms 11 and 12, the reaction moments can not only be supported but a weight support is provided as well. The torque support is extremely simple and especially space saving and an operation that is also functional and free of shearing forces is guaranteed. The arrangement is effective for new constructions but is particularly compact and well adapted to installation for existing roller presses.

In operation as the rollers are driven in rotation as shown by the arrowed lines in FIG. 1 adjacent the shafts 3 and 4 of the rollers, the reaction moments on the gearings are absorbed by twisting movements shown at 18 on the plate 16. These twisting movements are transmitted via the links 9 to the outer ends of the torque shafts 13 and 14 via the torsion arms 11. These movements are also supported and transmitted via the links 10 to the torsion arms 12 to the shafts 13 and 14 with the torsion being applied in an opposite direction relative to the outer arms 11. By dividing the connection between the outer links 9 and the arms at a further distance from the shafts 3 and 4 and transmitting this to the torsion shafts 13 and 14 by shorter arms 11, the torque forces can be balanced. That is, the links 10 which are connected at a shorter radial distance from the center of the shafts and transmit their twisting or torque forces via longer arms 12 thereby balancing the opposite twisting forces on the torsion shafts.

I claim as my invention:

1. A two roll mechanism such s a roller press having parallel rollers forming a crushing nip therebetween comprising in combination:

drive gearings connected to drive parallel rollers of a roller press adapted to each rotate about an axis;

torque supports for absorbing the reaction moments of the gearing having a plate member for each roller pivotable about the roller axis and extending longitudinally in opposite directions having an inner end between the rollers and an outer end outwardly of the rollers;

a torsion shaft for each plate member extending longitudinally beneath the torque supports each having an inner end and an outer end and having lever arms at each end to twist the shaft with the load on the gearings;

first rods connecting the lever arms at the outer ends of the torsion shafts to the outer ends of the plate members;

and second rods connecting the lever arms at the inner ends of the torsion shafts to the inner ends of the plate members;

the distance between the axis of each of the rollers and the outer ends of the plate members being greater than the distance between the axis of the rolls and the inner ends of the plate members.

2. The two roll mechanism such as a roller press having parallel rollers forming a crushing nip therebetween constructed in accordance with claim 1:

wherein the lever arms at the inner and outer ends of the shafts are of different lengths.

3. An improved two roll crusher constructed in accordance with claim 1:

wherein the torsion shafts absorb the weight of the bearing.

4. An improved two roll crusher constructed in accordance with claim 1:

wherein said rods are pivotally mounted to absorb lateral excursions of the plate means as material is fed into the nip between the rolls.

5. An improved two roll crusher constructed in accordance with claim 1:

wherein said torsion rods are positioned to be coaxial with each other.

6. An improved two roll crusher constructed in accordance with claim 1:

wherein said plates are located to be co-planar.

7. An improved two roll crusher constructed in accordance with claim 1:

including a pivotal connector for connecting each of the rods to the plate means to absorb lateral excursions of the plate means as material passes into the nip of the rolls.

8. An improved two roll crusher constructed in accordance with claim 1:

wherein said rods for the outer and inner ends of the plate members are of unequal length.

* * * * *